US011459932B2

(12) United States Patent
Reissig et al.

(10) Patent No.: US 11,459,932 B2
(45) Date of Patent: Oct. 4, 2022

(54) ARRANGEMENT AND METHOD FOR FASTENING A TAILPIPE COVER

(71) Applicant: Cisma Solutions ApS, Silkeborg (DK)

(72) Inventors: Sebastian Reissig, Striegistal (DE); Raul Jurj, Stuttgart (DE); Sebastian Radtke, Leinfelden-Echterdingen (DE)

(73) Assignee: Cisma Solutions ApS, Silkeborg (DK)

( * ) Notice: Subject to any disclaimer, the term of this patent is extended or adjusted under 35 U.S.C. 154(b) by 234 days.

(21) Appl. No.: 16/789,075

(22) Filed: Feb. 12, 2020

(65) Prior Publication Data

US 2020/0182122 A1 Jun. 11, 2020

Related U.S. Application Data

(63) Continuation of application No. PCT/EP2018/070816, filed on Aug. 1, 2018.

(30) Foreign Application Priority Data

Aug. 15, 2017 (DE) ..... 10 2017 214 199.9

(51) Int. Cl.
*F01N 13/08* (2010.01)
*F01N 13/18* (2010.01)

(52) U.S. Cl.
CPC ..... *F01N 13/082* (2013.01); *F01N 13/1805* (2013.01)

(58) Field of Classification Search
CPC .. F01N 2470/24; F01N 13/08; F01N 2450/24; F01N 2470/06; F01N 2450/20; F01N 2450/18; F01N 13/1844; F16L 9/02
See application file for complete search history.

(56) References Cited

U.S. PATENT DOCUMENTS 3,410,192 A * 11/1968 Neale ..... F01N 13/082 454/162
7,007,720 B1 * 3/2006 Chase ..... F16L 59/12 138/110
7,032,702 B2 * 4/2006 Rinklin ..... B60K 13/04 180/309
7,458,619 B2 * 12/2008 Cassel ..... F16L 21/005 285/420
8,312,961 B2 * 11/2012 Won ..... F01N 13/082 181/227
8,671,575 B2 * 3/2014 Yoo ..... B60R 19/023 29/897.2
9,926,828 B2 * 3/2018 Schwarz ..... F01N 13/20
10,590,828 B2 * 3/2020 Kohnlein ..... F01N 13/082
(Continued)

FOREIGN PATENT DOCUMENTS

DE 25 48 581 A1 5/1977
DE 102 33 498 A1 1/2004
(Continued)

*Primary Examiner* — Anthony Ayala Delgado
(74) *Attorney, Agent, or Firm* — Hackler Daghighian Martino & Novak

(57) ABSTRACT

An arrangement for fastening a tailpipe cover to a tailpipe is disclosed. The arrangement has a tailpipe cover, a tailpipe and a bracket. The bracket is arranged on the tailpipe cover. The tailpipe cover can be latched here to the tailpipe at a tailpipe projection, which is arranged on the tailpipe, by the bracket being deflected laterally in the circumferential direction of the tailpipe cover.

8 Claims, 5 Drawing Sheets

(56) References Cited

U.S. PATENT DOCUMENTS

| | | | | |
|---|---|---|---|---|
| 2015/0198078 | A1* | 7/2015 | O'Brien | B60R 13/0876<br>180/309 |
| 2017/0022874 | A1* | 1/2017 | Laursen | F16L 37/082 |
| 2017/0204772 | A1* | 7/2017 | Gao | F01N 3/05 |

FOREIGN PATENT DOCUMENTS

| | | | |
|---|---|---|---|
| DE | 10 2014 208 722 | A1 | 11/2015 |
| JP | 2001 342830 | A | 12/2001 |
| JP | 2008 190370 | A | 8/2008 |

* cited by examiner

ARRANGEMENT AND METHOD FOR FASTENING A TAILPIPE COVER

CROSS-REFERENCE TO RELATED APPLICATIONS

This continuation application claims priority to PCT/EP2018/070816 filed on Aug. 1, 2018 which has published as WO 2019/034420 A1 and also the German application number 10 2017 214 199.9 filed on Aug. 15, 2017, the entire contents of which are fully incorporated herein with these references.

FIELD OF THE INVENTION

The invention relates to an arrangement for the stable and, when executed repeatedly, reliable fastening of a tailpipe cover on a tailpipe. The invention also relates to a tailpipe cover arrangement, in which the tailpipe cover is fastened to the tailpipe in a stable and reliable manner. Furthermore, the invention relates to providing a method for the stable and reliable fastening of a tailpipe cover on a tailpipe.

BACKGROUND OF THE INVENTION

For fastening a tailpipe cover to a tailpipe, it is known from prior art to push a bracket, which is fastened to the tailpipe cover, over a tailpipe projection by radially bending the bracket. This process takes place until the tailpipe projection latches into a recess in this bracket, by means of which the tailpipe cover is fixed to the tailpipe.

In a disadvantageous manner, the bracket may become damaged due to friction forces and bending if it is pushed over the tailpipe projection, especially when this is performed repeatedly. In a disadvantageous manner, a large section of the bracket is unprotected, by means of which damage may also result. Furthermore, the radially bendable bracket is visible from the outside in a visually disadvantageous manner.

Therefore, it is the object of the invention to provide an arrangement in which the tailpipe cover can be fastened to the tailpipe in a stable and, when executed repeatedly, reliable manner in an visually advantageous manner. It is also the object of the invention to provide a tailpipe cover arrangement in which the tailpipe cover is fastened in an visually advantageous manner. Furthermore, it is an object of the invention to provide a method for fastening a tailpipe cover in a stable and reliable manner to a tailpipe in a visually advantageous manner.

The task is achieved by an arrangement according to claim 1. The tailpipe cover arrangement has the features indicated in claim 9. The features of the method according to the invention are indicated in claim 10. Advantageous designs follow from the respective related dependent claims.

SUMMARY OF THE INVENTION

The arrangement according to the invention for fastening a tailpipe cover to a tailpipe comprises a bracket. This bracket is arranged or designed on the tailpipe cover in such a manner that the tailpipe cover can be latched to a tailpipe projection by the lateral deflection of the bracket in the circumferential direction of the tailpipe cover.

In particular, the bracket may have a component, of metal for example, that is longitudinally bendable and/or rotatable about a fixed point. The bracket may have a free end, which is not arranged or designed on the tailpipe cover. This free end may be moveable and/or deformable and/or rotatable. It may be pushed to the side by the tailpipe projection and then move back elastically into its original position.

The bracket may be designed integrally with the tailpipe cover. The bracket may be designed or arranged on one side of the tailpipe cover on the edge of the tailpipe cover.

According to the invention, the tailpipe cover has a latch mechanism having the laterally deflectable bracket. The latch mechanism has one or more components, by means of which the tailpipe projection can be fixed in its position, including the bracket. The latching is to be sufficiently strong in particular that it is not detached by a withdrawal force of 250 N.

Advantageously, the bracket may be arranged at least sectionally on the interior side of the tailpipe cover. Only a section of the bracket is hereby visible and the rest of the bracket is protected by the tailpipe cover. In an visually advantageous manner, the tailpipe projection can be designed in a manner that is comparatively flat and covered by the tailpipe cover. Alternatively or additionally, the bracket may be designed or arranged in an visually advantageous manner by being covered by the tailpipe cover. Furthermore, the bracket can be designed flat since only a lateral deflection is necessary. If the bracket, as is known from prior art, is pushed over the tailpipe projection, it must have a certain minimum length in relation to said tailpipe projection so that the setting angle does not become too large and the bracket breaks. Such a minimum length that is contingent on a setting angle is not required with the bracket according to the invention, so that said bracket can be designed to be comparatively short. This ensures greater stability and less wear of the bracket.

Furthermore, when assembling the tailpipe cover according to the invention, no noteworthy frictional forces occur as is the case when the bracket is pushed over the tailpipe projection or the fastening claws used in prior art are pushed over the tailpipe projection, so that the force and material costs required for assembly are reduced. A click sound when the tailpipe projection latches after the lateral deflection of the bracket can indicate to the assembler that assembly has taken place.

In an advantageous design of the arrangement, the tailpipe cover has a recess on an end at which the bracket is designed or arranged. The edge of the recess can hereby adjoin the tailpipe projection at least in a sectionally form-fitting manner. This adjacency can be designed in such a manner that the recess forms a stop for the tailpipe projection. The width of the recess, in other words especially the dimension of the recess perpendicular to an axis parallel to the longitudinal axis of the tailpipe cover and perpendicular to the radial axis of the tailpipe cover, may be equal to or greater than the width of the tailpipe projection in order for the tailpipe projection to latch. In an overhead view, the longitudinal axis of the tailpipe cover runs especially parallel to the longitudinal axis of the tailpipe cover. In an overhead view, the tailpipe cover and the tailpipe are preferably each designed symmetrically to these longitudinal axes.

The bracket may be arranged or designed on the edge of the recess. A free, non-fastened end of the bracket may be spaced apart from the recess in such a manner that the recess contacts the tailpipe projection at two opposite sides when the tailpipe projection contacts the brackets, especially the end point of the bracket. In this way, the tailpipe projection can be fixed in its position, in which it is arranged in mechanical contact at the recess and at the bracket, especially the free end of the bracket.

By means of a recess of the tailpipe cover, which is arranged on the tailpipe projection, one can prevent, while saving on material, the tailpipe cover from rotating around the tailpipe or from being pushed out of its assembly position further over the tailpipe.

In an advantageous design, the arrangement has an additional bracket. This additional bracket is arranged or designed on the tailpipe cover. The tailpipe cover can hereby be latched to the tailpipe projection by the bracket and the additional bracket. An additional bracket can increase the stability of the latching engagement.

In an advantageous design of the arrangement, the bracket and the additional bracket are arranged in a manner where they converge towards each other. In particular, they may be designed to converge towards each other at an acute angle. When the brackets are designed to converge towards each other, they can counteract a movement of the tailpipe cover in an especially forceful manner, by means of which the tailpipe projection is pushed against the brackets.

In an advantageous design of the arrangement, the bracket and the additional bracket have the same length. Then they can simultaneously counteract a movement of the tailpipe cover, by means of which the tailpipe projection is pushed against the brackets.

In another design of the arrangement, the bracket and the additional bracket have different lengths. The shorter bracket may be arranged to converge at an acute angle toward the longer bracket. The brackets may then be arranged for example in the shape of a lower case lambda letter. Then, given a corresponding displacement of the tailpipe cover, the tail pipe projection can initially be pushed against the longer bracket. This bracket is then pressed against the short bracket so that a blocking mechanism occurs, wherein the shorter bracket braces the longer bracket.

In an advantageous design of the arrangement, the bracket and the additional bracket are arranged or designed on opposite sides of the recess of the tailpipe cover. In particular, the brackets are oriented with their free ends pointing into the recess. The respective bracket is oriented with its free, non-fastened end toward the end of the tailpipe cover, which is opposite the end on which the bracket is arranged. The free, non-fastened end of the respective bracket lies, in comparison to the fixed end of this bracket, closer to the end of the tailpipe cover, which in the axial direction parallel to the longitudinal axis of the tailpipe cover is opposite the end of the tailpipe cover having the recess.

On one side of the tailpipe projection in each case, the brackets can then act on said projection, especially if the latter is arranged symmetrically along the centerline of the recess of the tailpipe cover. The force associated with this effect is then greatest when the brackets are oriented with their respective free end pointing into the recess.

In an advantageous design of the arrangement, the bracket has at least a bent shape in a section, by means of which it can partially engage around the tailpipe projection in such a manner that the tailpipe cover can be latched to the tailpipe projection. The arc-shaped section may be especially designed in such a manner that it can be joined at least sectionally, especially entirely, to the tailpipe projection in a form-fitting manner. The arc-shaped section may have the shape of a circular arc, for example the circular arc of semi-circle. The circular arc can especially be designed in such a manner that it can engage around a section of the tailpipe projection, which is arranged on one side of the tailpipe projection, and especially a section, which is arranged on the opposite side of the tailpipe projection. If the bracket has a curved or curve-shaped section, the latching engagement can hereby be effected advantageously without additional aids aside from the bracket.

A tailpipe cover arrangement comprises a tailpipe having a tailpipe projection and an arrangement according to the invention for fastening a tailpipe cover to the tailpipe. The tailpipe cover is hereby latched to the tailpipe projection after a lateral deflection of a bracket in the circumferential direction of the tailpipe cover. In this way, the tailpipe cover can be latched advantageously to the tailpipe in a stable and non-failure-prone manner.

In an advantageous design, the arrangement according to the invention has the following components to effect a limitation in the displacement of the tailpipe cover:

A tailpipe cover;

An additional stop;

A displacement path.

The extra stop is hereby arranged or designed as part of an additional latch mechanism. By means of the additional latch mechanism, the tailpipe cover can be latched to a tailpipe projection. The additional stop can correlate with the stop. The additional latch mechanism can correlate with the latch mechanism. The displacement path is thereby arranged or designed in such a manner that given a displacement of the tailpipe cover in the assembled state, the tailpipe cover can be guided along the displacement path along the tailpipe projection.

The additional stop can especially have at least one component, which is displaced at least with a section on the tailpipe projection, when the tailpipe cover is displaced in a direction, especially toward the tailpipe projection, over the tailpipe. The tailpipe projection may be arranged in the movement direction of this component or on the movement path of this component given a displacement of the tailpipe cover over the tailpipe. By means of a form fit with the tailpipe projection, the component then prevents the further movement of the tailpipe cover in this movement direction. The movement direction or movement path of the component correlates with the displacement direction or displacement path of the tailpipe cover or runs parallel to it.

The additional stop may be designed as part of an additional latch mechanism, which has especially at least one component. This component may correlate with the component of the additional stop. The component can thereby have at least one section, by means of which the tailpipe projection can be fixed by mechanical contact, especially touch, in a position relative to the tailpipe cover. The component can, alone or together with other components, engage around the tailpipe projection at least sectionally in a form-fitting manner.

It can hereby involve especially an elastic or springy component. In that case, the tailpipe projection can, in its movement, push the springy component to the side and subsequently be fixed in its position by the component alone or by the component along with the other components. In this way, the tailpipe cover can be fastened to the tailpipe.

The displacement direction or displacement path of the tailpipe cover during a displacement from its assembly position over the tailpipe toward the tailpipe projection is determined in this embodiment especially by the displacement path. The displacement path is arranged especially in an axial direction parallel to the longitudinal axis of the tailpipe cover on one side of the additional stop. This side of the additional stop is opposite the side of the additional stop, with which the additional stop comes into mechanical contact with the tailpipe projection when the tailpipe cover is displaced. At the additional stop, the displacement path has at least a width, perpendicular to the longitudinal axis of the tailpipe cover, which is at least as large as the width of the tailpipe projection. The displacement path may be guided along the tailpipe projection when the additional stop is moved past the tailpipe projection. Advantageously, the movement of the tailpipe cover can be executed in a controlled manner by the displacement path when it is displaced out of its assembly position over the tailpipe toward the tailpipe projection, especially in the case of a rear-end collision. By this means, the exhaust system, the tailpipe, the tailpipe cover as well as the tailpipe projection can be protected in such an accident.

In an advantageous design of the arrangement, the additional stop is arranged or designed on at least one additional bracket. The additional bracket can correlate with the bracket. The additional bracket may comprise an elastic or springy material and/or be rotatable and/or deformable about a fixed point. It may be arranged or designed on the tailpipe cover. A section of the additional bracket, especially an end of the additional bracket, can thereby come into mechanical contact with the tailpipe projection and be guided along one side of the tailpipe projection when the tailpipe cover is pushed during its assembly over the tailpipe. The additional bracket is hereby initially pushed, especially in the circumferential direction of the tailpipe cover, to the side and subsequently moved back again toward its starting position, while it is moved along the tailpipe projection. The section contacting the additional bracket can hereby contact the tailpipe projection in a form-fitting manner and prevent further movement of the tailpipe cover in the displacement direction, especially if the additional bracket goes back again to its starting position.

The additional bracket can be designed alone and/or together with other components as an additional latch mechanism. The section of the additional bracket, which contacts the tailpipe projection, can by itself or with other components or their sections, such as a recess of the tailpipe cover, prevent further movement of the additional bracket and thus the tailpipe cover relative to the tailpipe projection.

The section of the additional bracket, which contacts the tailpipe projection, can be designed especially as a curved section, which can engage around the tailpipe projection entirely or sectionally. The curved section of the additional bracket can thereby be designed in the shape of a circular arc. If such a curved section of the additional bracket engages around the tailpipe projection, the latter can be fixed in its position relative to the additional bracket and thus the tailpipe cover. The edge of the arc-shaped section of the additional bracket forms an additional stop for the tailpipe projection. At the same time, the additional bracket forms the additional latch mechanism with which the tailpipe projection can be fastened or latched to the tailpipe without additional aids.

In an advantageous embodiment of the arrangement, the additional stop is designed as part of the edge boundary of an additional recess of the additional latch mechanism. The additional recess can correlate with the recess. If the tailpipe cover has an additional recess, then the tailpipe cover can be pushed over the tailpipe until the tailpipe projection contacts the edge of the recess. The form-fit of the tailpipe projection and tailpipe cover prevents further displacement of the tailpipe cover in the displacement direction. By means of an additional recess, an additional stop can be created in a material-saving manner, said stop preventing, in addition to displacements, rotational movements of the tailpipe cover, especially about the longitudinal axis of the tailpipe cover. The additional recess may form part of an additional latch mechanism. For this purpose, the additional recess can be designed in such a manner that it can engage around the tailpipe projection sectionally or entirely.

The displacement of the tailpipe cover during assembly occurs especially in an axial direction parallel to the longitudinal axis of the tailpipe cover toward the tailpipe projection. The additional recess of the tailpipe cover can then be arranged in this axial direction and be designed especially in a symmetrical manner in relation to an axis through the tailpipe projection parallel to the longitudinal axis of the tailpipe cover. In this case, the tailpipe cover can be moved in this displacement direction until the tailpipe projection contacts the edge of the additional recess, especially on two opposite sides of the additional recess. The additional recess then also prevents further movement of the tailpipe cover in this axial direction.

In an advantageous design of the arrangement, the additional stop is arranged or designed in a reversibly deformable manner so that the tailpipe cover can be pushed back after displacement in such a manner that the tailpipe projection can be guided back along the displacement path to the additional stop without permanently deforming the additional latch mechanism. The tailpipe cover may comprise elastic material, especially on the edge of the displacement path and/or the additional stop. When the tailpipe cover is displaced further out of its assembly position over the tailpipe, then the additional stop is moved away from the tailpipe projection and the displacement path is moved along the tailpipe projection. If the edge of the displacement path and/or the additional stop comprise elastic material, the tailpipe cover can be moved back after the displacement has ended until the tailpipe projection assumes its starting position at the additional stop. No permanent deformation thereby occurs on the tailpipe cover and/or the additional stop.

In an advantageous design of the arrangement, the additional stop is arranged or designed on the tailpipe cover in such a manner that the tailpipe cover can be latched to a tailpipe projection by the lateral deflection of the additional bracket in the circumferential direction of the tailpipe cover. The circumferential direction can thereby be defined relative to the longitudinal axis of the tailpipe cover in such a manner that the circumferential direction corresponds to a direction perpendicular to the radial extension of the tailpipe cover, wherein the radial extension begins at the longitudinal axis.

A section of the additional bracket may be spaced apart from the edge of the tailpipe cover in such a manner that the edge of the tailpipe cover contacts the tailpipe projection when the tailpipe projection contacts the additional bracket and especially contacts this section of the additional bracket. In particular, a free, non-fastened end of the additional bracket may be spaced apart from the additional recess in such a manner that the additional recess contacts the tailpipe projection on two opposing sides when the tailpipe projection contacts the free end of the additional bracket. In that case, during assembly of the tailpipe cover, the additional bracket can be pushed to the side by the tailpipe projection in the circumferential direction of the tailpipe cover. The tailpipe cover can then be latched to the tailpipe projection when the additional bracket is moved further past the tailpipe projection in the region of its largest width in a direction perpendicular to the longitudinal axis of the tailpipe cover and is moved back to its starting position.

In an advantageous design, the arrangement has another additional stop. This other additional stop is arranged or designed so as to be spaced apart from the additional stop as part of another additional latch mechanism. The other additional latch mechanism can thereby latch the tailpipe cover to the tailpipe projection. By means of the other additional stop, the tailpipe cover can be greatly decelerated during the displacement out of its assembly position. When the movement of the tailpipe cover has ended, the tailpipe cover can be fastened back to the tailpipe by means of the other additional latch mechanism.

In an advantageous design of the arrangement, the other additional stop is arranged or designed on the same additional bracket as the additional stop or at least on another additional bracket arranged or designed on the tailpipe cover. Advantageously, the other additional stop can be produced by an additional bracket without additional components, especially by the same additional bracket, by means of which the additional stop is manufactured.

In an advantageous design of the arrangement, the displacement path is arranged or designed in such a manner that when the tailpipe cover is displaced, the displacement path can be guided along the tailpipe projection in such a manner that the tailpipe projection can be transferred from a position on the additional stop to a position on the other additional stop. Behind the additional stop, another additional stop for the tailpipe projection can be arranged or designed along the displacement path. The tailpipe projection can hereby be controllably guided from an additional stop to the next additional stop during the displacement of the tailpipe cover from its assembly position. The tailpipe cover can thereby be controllably decelerated once or multiple times.

In an advantageous design of the arrangement, the other additional stop is designed as part of the edge border of another additional recess of the other additional latch mechanism. An additional stop can hereby be formed in the tailpipe cover without additional components. The other additional recess may be connected to the additional recess, wherein the connection may also have the form of an additional recess.

In an additional design of the arrangement, the additional stop and the other additional stop are arranged or designed on the respective additional bracket in an identical manner.

In an additional design of the arrangement, the other additional stop is designed or arranged on at least an additional bracket, which is arranged or designed on the tailpipe cover in such a manner that the tailpipe cover can be latched to a tailpipe projection by the lateral deflection of the additional bracket in a circumferential direction of the tailpipe cover. The other additional stop can be produced by only one additional bracket without additional components, wherein the latching engagement of the tailpipe cover by means of the lateral deflection of the additional bracket allows for fastening the tailpipe cover to the tailpipe in a manner that is less prone to failure.

In an advantageous design of the arrangement, the displacement path has a braking mechanism. The latter may engage at the tailpipe projection. The braking mechanism can decelerate the displacement of the tailpipe cover. The braking mechanism may be designed for example in the form of a raw surface and/or in the form of a narrowing of the displacement path along which the tailpipe projection slides. A deceleration, especially a continuous deceleration, of the movement of the tailpipe cover can hereby be effected.

In another design, the arrangement may have the following components:

A tailpipe cover;

An additional stop;

A displacement path;

A tailpipe having a tailpipe projection.

The additional stop may thereby be arranged or designed as part of an additional latch mechanism. By means of the additional latch mechanism, the tailpipe cover can be latched to the tailpipe projection of the tailpipe. The displacement path can hereby be arranged or designed on the additional stop in such a manner that when the tailpipe cover is displaced, the displacement path can be guided along the tailpipe projection. When the tailpipe cover is displaced out of its assembly position, the displacement path advantageously allows control of the movement of the tailpipe cover in a rear-end collision.

In an advantageous design, the arrangement according to the invention has a tailpipe cover, a clamping element and a tailpipe to effectuate a deceleration of the displacement of the tailpipe cover. The clamping element may be furnished with an elastic material and be arranged at least indirectly both on the tailpipe cover as well as the tailpipe. A section of the clamping element may project beyond the tailpipe in an axial direction parallel to the longitudinal axis of the tailpipe cover. In this section that extends beyond the tailpipe, the clamping element may be designed in a manner that is in part at least radially smaller than the tailpipe. Alternatively or additionally, at least one section of the clamping element may be arranged on the tailpipe at least in an indirectly non-displaceable manner in an axial direction parallel to this longitudinal axis.

The clamping element may have in particular a spring element or a springy element. Such a spring element may have coils or folds. Furthermore, the clamping element may have bendable and/or rotatable lever arms, especially elastic lever arms, which are rotatable or bendable about a fixed point. The clamping element may be stretched or compressed or twisted and/or bent sectionally, especially at the lever arms. In this way, the clamping element can elastically exert a force or effect directed against the acting force.

The clamping element may have a section extending beyond the tailpipe. An end of the clamping element is arranged offset to the free end of the tailpipe, especially in an axial direction parallel to the longitudinal axis of the tailpipe cover.

In a radial direction, the distance between the longitudinal axis of the tailpipe cover and this section, extending beyond the tailpipe, of the clamping element may be at least sometimes smaller than the distance between the longitudinal axis of the tailpipe cover and the exterior wall of the tailpipe. This can pertain to at least the side of the section, projecting beyond the tailpipe, that faces this longitudinal axis. In this way, this section can be moved toward to the tailpipe when the tailpipe cover is displaced or moved out of its assembly position toward the tailpipe, or toward the longitudinal axis of the tailpipe cover or toward an axis parallel to this longitudinal axis. This displacement can then be stopped by the clamping element in an elastic manner.

Alternatively or additionally, a section of the clamping element may be arranged on the tailpipe in such a manner that this section cannot be displaced toward the longitudinal axis of the tailpipe cover or in an axial direction parallel to this longitudinal axis. The clamping element of an elastic material can then also be compressed or stretched or sectionally bent by a force, which acts in an axial direction parallel to this longitudinal axis on the clamping element. In this way, the clamping element can in turn exert a force or effect, which is opposite to such an acting force. In this way, the movement or displacement of the tailpipe cover can be decelerated or stopped. This arrangement of the clamping element or the section of the clamping element at the tailpipe can be present directly or indirectly, for example when additional layers are arranged between the clamping element and the tailpipe.

Advantageously, damage can be prevented in this way while exploiting the spring-type effect of the elastic material in the clamping element when the tailpipe cover is displaced out of its assembly position further over the tailpipe. In particular, the movement of the tailpipe cover can be decelerated and/or terminated in a controlled manner by the arrangement according to the invention, and/or the tailpipe cover can be moved back into its assembly position by the spring effect of the clamping element.

In an advantageous design of the arrangement, the tailpipe contacts the clamping element with its free end. The tailpipe contacts the clamping element with its free end or is in mechanical contact with the clamping element with its free end. The springy braking effect of the clamping element can be effectuated directly when movement of the tailpipe cover occurs.

In an advantageous design of the arrangement, an end section of the clamping element is designed in a hook shape. The end section thus has in particular a bend or curve, by means of which it assumes the shape of a hook. Given a hook-shaped design of the end section of the clamping element, a bending process or sliding process can modify the surface on which the maximum force acts during the braking process. This has a protective effect on the clamping element. Given a hook-shaped design of the end section, the braking effect can also be gradually increased as the bending of the clamping element increases, which makes gentle braking possible.

In an advantageous design of the arrangement, an end section of the tailpipe cover is designed to have a hook shape. The end section thus has in particular a bend or curve, by means of which it assumes the shape of a hook. In particular, it may have a bend of 180°. The end of the tailpipe cover can then point towards the clamping element to effectuate the braking or termination of the tailpipe cover movement mentioned above.

In another design of the arrangement, the end section of the clamping element and the end section of the tailpipe cover lie next to each other. The end section of the clamping element can hereby contact the end section of the tailpipe cover only in a narrow strip or be in mechanical contact with it over a larger surface area. In particular, the end of the tailpipe cover can be arranged on the end section of the clamping element in such a manner that a displacement of the tailpipe cover out of its assembly position effectuates a bending or rotation of the end section of the clamping element, by means of which a braking of this displacement occurs. This pertains especially to the situation, in which the end section of the clamping element and the section of the tailpipe cover are both designed in a hook-shaped manner.

In an advantageous design of the arrangement, the clamping element has at least sectionally a curve-shaped profile. A spring-like braking effect of the clamping element can hereby be reinforced.

In an advantageous design of the arrangement, the tailpipe cover has a bumper on the one end. In the assembled state of the tailpipe cover, the bumper can bump up against the tailpipe when the tailpipe cover is moved in an axial direction parallel to the longitudinal axis of the tailpipe cover. In particular, an end section of the clamping element is arranged on the bumper. The bumper may also comprise elastic material. It may be designed in the shape of an elongated rod or bolt, especially having a bend or curve. One end of the bumper may be oriented toward the tailpipe. By means of a bumper, the displacement or movement of the tailpipe cover can be braked in an attenuated manner.

In an advantageous design of the arrangement, the clamping element is arranged on an installation pipe. The installation pipe is hereby arranged on the exterior wall of the tailpipe. By means of such an installation pipe, the tailpipe cover and the clamping element arranged on the tailpipe cover can be simply installed on the tailpipe, by the installation pipe being pushed over the tailpipe or its free end. On the installation pipe, there may be designed in particular a hook-shaped end section, which is arranged on the one end of the tailpipe. In particular, a hook-shaped end section forms additional protection for the tailpipe. For this purpose, the hook-shaped end section can at least partially cover the tailpipe.

In an advantageous design of the arrangement, the clamping element is at least indirectly fastened to the tailpipe or connected to the tailpipe. In particular, the clamping element is fastened to the tailpipe in a non-destructively detachable manner or connected to the tailpipe. When the clamping element is fastened to the tailpipe, it is rigidly arranged or fixed not only in an axial direction parallel to the longitudinal axis of the tailpipe cover but in every direction. The clamping element can hereby be stably arranged on the tailpipe, by means of which braking of the displacement of the tailpipe cover can be reliably effectuated. For fastening purposes, the clamping element may be welded to the tailpipe for example. In a non-destructively detachable manner, the clamping element can be fastened to the tailpipe by being screwed or clamped for example. Among other things, when replacing the clamping element, it can then be removed from the tailpipe without damaging the tailpipe.

In an advantageous design of the arrangement, the clamping element is fastened to the tailpipe cover or connected to the tailpipe cover. In particular, the clamping element is fastened to the tailpipe cover in a non-destructively detachable manner. The clamping element can hereby be arranged on the tailpipe in a stable and non-displaceable manner in every direction. When the clamping element is also fastened to the tailpipe, the tailpipe cover is stably fastened via the clamping element to the tailpipe without additional components.

In a method for fastening an arrangement to a tailpipe, wherein a tailpipe cover of the arrangement has a bracket, the tailpipe cover is latched to a tailpipe projection by the lateral deflection of the bracket in the circumferential direction of the tailpipe cover. The latching engagement of the tailpipe cover to the tailpipe can be advantageously effectuated by such a method in a visually unobtrusive and stable manner that is less prone to failure.

In an advantageous design of the method, a tailpipe cover can be latched to a tailpipe projection by an additional latch mechanism. An additional stop can thereby be arranged or designed as part of an additional latch mechanism. By means of the additional latch mechanism, the tailpipe cover can be latched to the tailpipe projection of the tailpipe. The displacement path can hereby be arranged or designed on the additional stop in such a manner that when the tailpipe cover of the tailpipe is displaced, the displacement path can be guided along the tailpipe projection. Advantageously, the movement of the tailpipe cover can be controllably executed by the displacement path when the tailpipe cover is displaced out of its assembly position over the tailpipe in a rear-end collision. The tailpipe can hereby be protected.

In an advantageous design of the method, a clamping element comprising elastic material may be arranged on a tailpipe cover and on a tailpipe. A section of the clamping element may project toward the longitudinal axis of the tailpipe cover beyond the tailpipe. In this section, which projects beyond the tailpipe, the clamping element may be designed at least sometimes radially smaller, in relation to the longitudinal axis of the tailpipe cover, than the tailpipe. Alternatively or additionally, for this purpose at least one section of the clamping element may be arranged on the tailpipe at least in an indirect and rigid manner in the direction of this longitudinal axis. The clamping element is then elastically deformed in a rear-end collisional by a displacement or movement of the tailpipe cover in an axial direction parallel to the longitudinal axis of the tailpipe cover. This movement of the tailpipe cover is thereby decelerated. In particular, despite the large forces occurring in an accident, the movement of the tailpipe cover toward the tailpipe can be decelerated and/or terminated in an attenuated manner by the elastic clamping element. Non-destructive braking of the displacement of a tailpipe cover can hereby be effectuated in the direction of the longitudinal axis of the tailpipe.

BRIEF DESCRIPTION OF THE DRAWINGS

Additional features and advantages of the invention emerge from the detailed description below of multiple embodiments of the invention, from the claims as well as from the figures of the drawing, which depicts key details of the invention. The various features may be implemented each individually or in any of various combinations for variants of the invention. The features shown in the drawing are depicted in such a manner that the particularities according to the invention can be made readily visible.

The drawings depict.

DETAILED DESCRIPTION OF THE PREFERRED EMBODIMENTS

Figure 1:
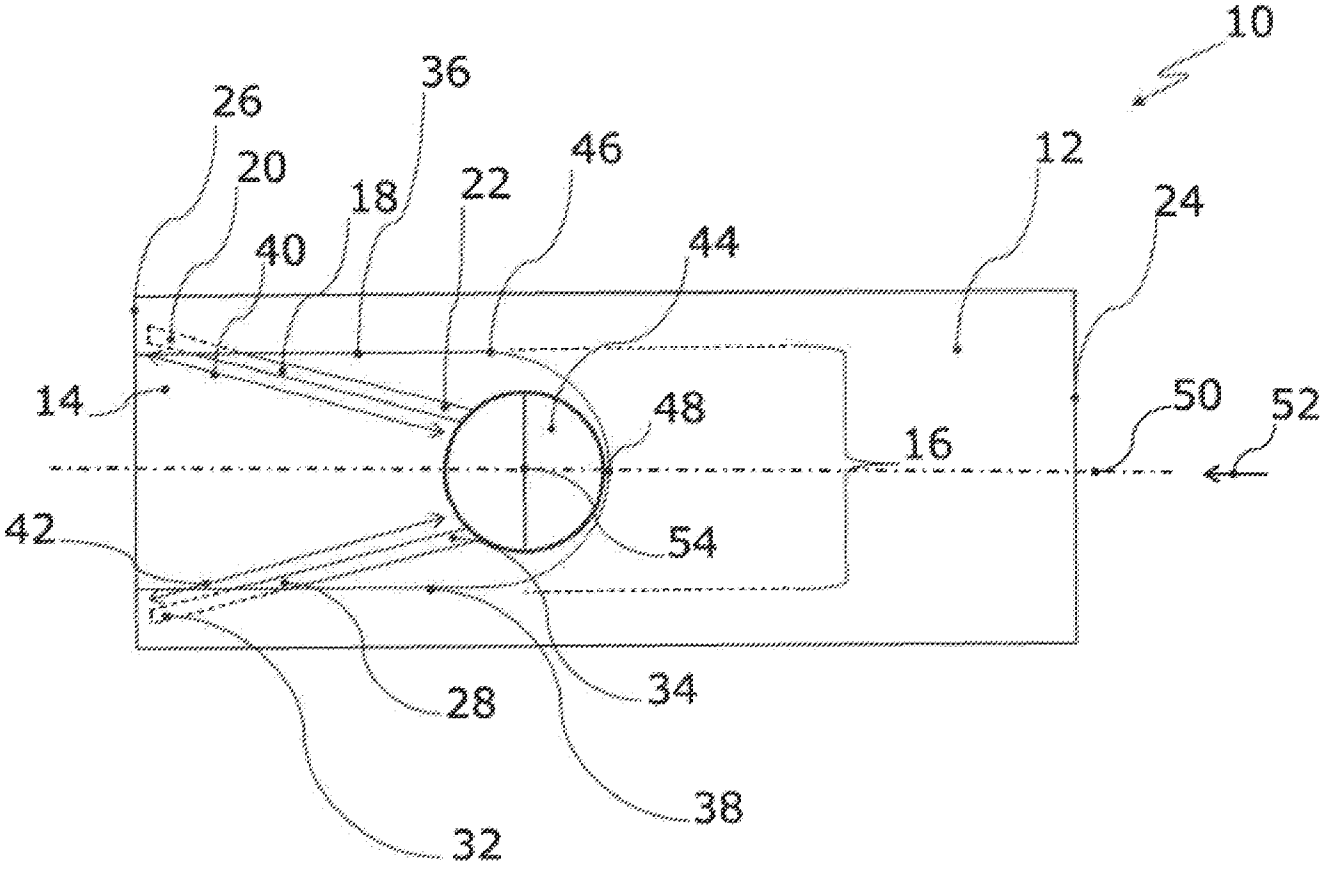
FIG. 1 is a schematic partial overhead view of a first embodiment of the arrangement for fastening a tailpipe cover.

FIG. 1 depicts an overhead view of a first embodiment of the arrangement 10 according to the invention for fastening a tailpipe cover 12 to a tailpipe 14. The tailpipe cover 12 has a recess 16. A bracket 18 is arranged or designed on the tailpipe cover 12. The bracket 18 has a fixed end 20, which is arranged on the tailpipe cover 12 as well as between the tailpipe cover 12 and the tailpipe 14. The bracket 18 also has a free end 22, which is not arranged on the tailpipe cover 12. The bracket 18 can be deformed and/or rotated on the free end 22. The free end 22 of the bracket 18 points into recess 16. The bracket 18 is oriented, from its fixed end 20 to its free, non-fastened end 22, toward the end 24 of the tailpipe cover 12, which is opposite the end 26 of the tailpipe cover 12, on which the bracket 18 is arranged. The end 24 is in particular the free end of the tailpipe cover 12. Compared to the fixed end 22 of the bracket 18, the free, non-fastened end 20 of the bracket 18 is closer to the end 24 of the tailpipe cover 12, which is opposite the end 26 of the tailpipe cover 12, on which the recess 16 is arranged.

There is also arranged on the tailpipe cover 12 an additional bracket 28, which has a corresponding fixed section 32 and a corresponding free end 34. The bracket 18 is arranged on a first side 36 of the recess 16 and the other bracket 28 is arranged on a second side 38 of the recess 16. The first side 36 and the second side 38 face each other. The bracket 18 and the other bracket 28 are arranged or designed to converge toward each other at an acute angle. The length 40 of the bracket 18 and the length 42 of the other bracket 28 are equal.

A tailpipe projection 44 is arranged or designed on the tailpipe 14. The tailpipe projection 44 is arranged on the edge 46 of the recess 16 in a symmetrical manner in relation to the first side 36 and the second side 38 of the recess 16. In an overhead view, it is arranged symmetrically at the apex 48 of the recess 16 and in relation to the axis of symmetry 50 of the tailpipe cover 12. The edge 46 of the recess 16 forms a stop for the tailpipe projection 44. The free end 22 of the bracket 18 and the free end 34 of the other bracket 28 abut the tailpipe projection 44. The tailpipe projection 44 is latched by the bracket 18, the other bracket 28 and the edge 46 of the recess 16. It is fixed in its position relative to the tailpipe cover 12. The tailpipe cover 12 is thereby fastened via the tailpipe projection 44 to the tailpipe 14.

For assembling the tailpipe cover 12 to the tailpipe 14, the tailpipe cover 12 is moved from one end of the tailpipe 14 over the tailpipe 14 in a direction 52 parallel to the axis of symmetry 50 of the tailpipe cover 12, wherein the tailpipe projection 44 is arranged symmetrically between the first side 36 and the second side 38 of the recess 16. The recess 16 is guided along the tailpipe projection 44, wherein the tailpipe projection 44 remains in its symmetrical position between the first side 36 and the second side 38 of the recess 16. The respective free end 22, 34 of the bracket 18 and the other bracket 28 are moved to the side by the tailpipe projection 44 in the circumferential direction of the tailpipe cover 12. These free ends 22, 34 hereby abut the tailpipe projection 44. The bracket 18 and the other bracket 28 are moved past the tailpipe projection 44 in the region of its largest dimension 54 in a direction perpendicular to the axis of symmetry 50 of the recess 16 and move toward their starting position.

The strength of the latching engagement is at a maximum when the bracket 18 and the other bracket 28, in their starting position, abut the tailpipe projection 44 with their respective free ends 22, 34, wherein the tailpipe projection 44 is arranged, in relation to the first side 36 and the second side 38 of the edge 46 of the recess 16, symmetrically to this edge 46 and to the apex 48 of the recess 16. For depiction-related reasons, the tailpipe projection 44 is shown slightly spaced apart from the edge 46 of the recess 16.

Figure 2:
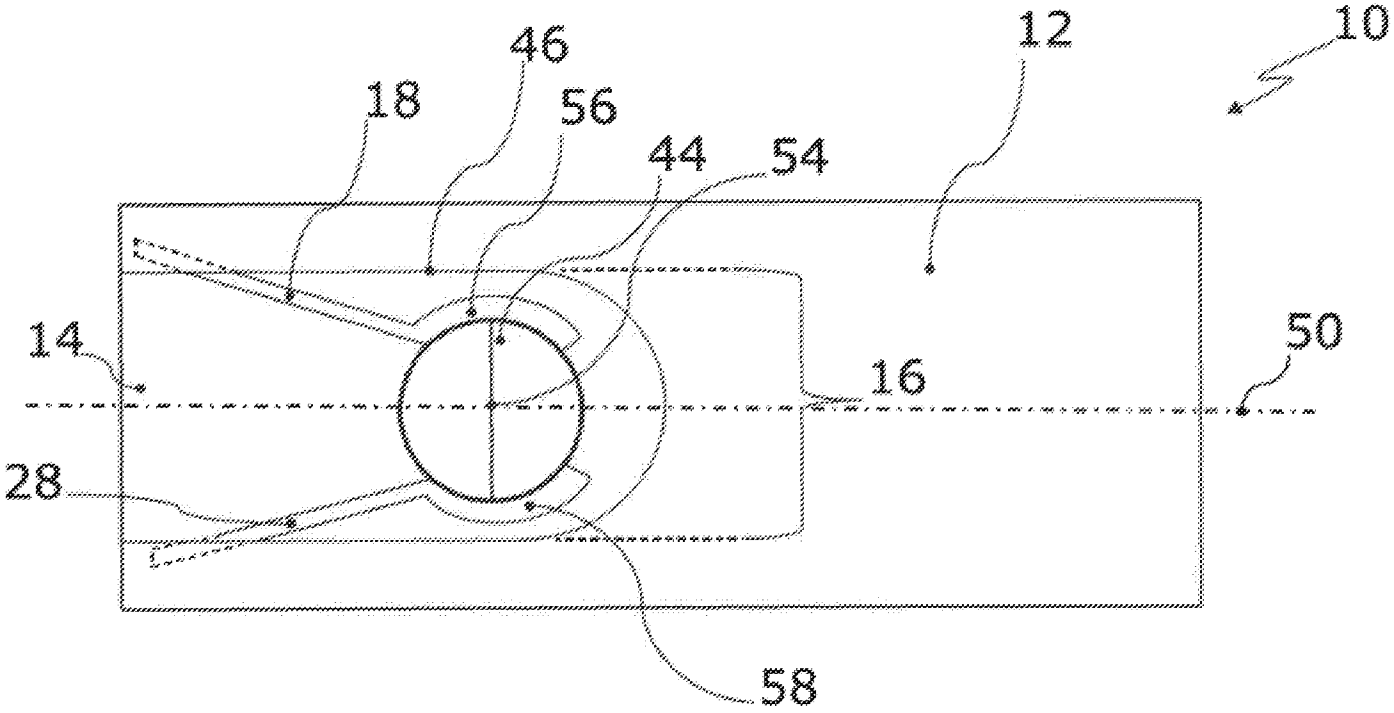
FIG. 2 is a schematic partial overhead view of a second embodiment of the arrangement for fastening a tailpipe cover.

FIG. 2 depicts an overhead view of a second embodiment of the arrangement 10 according to the invention for fastening a tailpipe cover 12 to a tailpipe 14. In contrast to the first embodiment of the arrangement 10, a bracket 18 has a curve-shaped section 56, with which it engages around a tailpipe projection 44 in a section about its largest dimension 54 perpendicular to the axis of symmetry 50 of the tailpipe cover 12. The other bracket 28 also has a corresponding curve-shaped section 58, with which it engages around a corresponding section of the tailpipe projection 44. The tailpipe projection 44 can hereby be fixed in its position relative to the tailpipe cover 12. The tailpipe cover 12 is then fastened to the tailpipe 14. The arrangement of the tailpipe projection 44 on the edge 46 of the recess 16 is optional.

Figure 3:
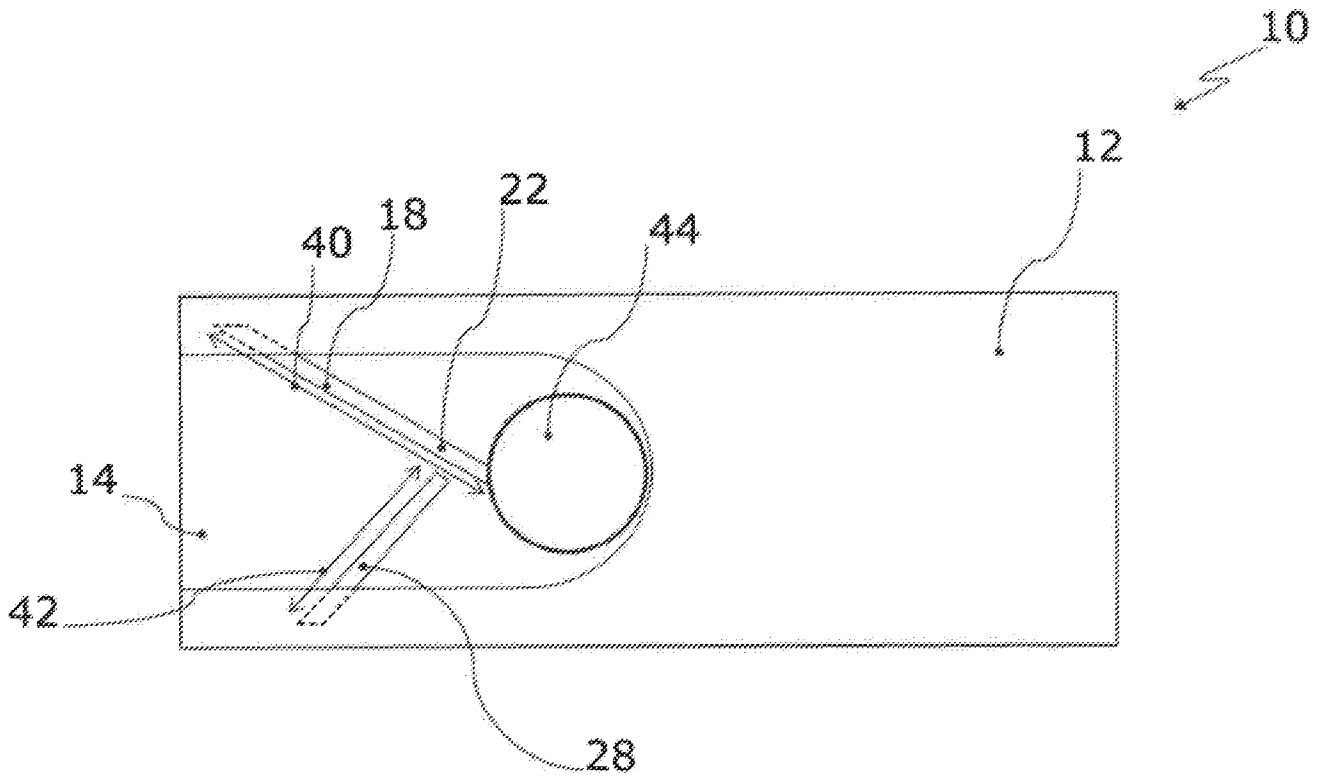
FIG. 3 is a schematic partial overhead view of a third embodiment of the arrangement for fastening a tailpipe cover.

FIG. 3 depicts an overhead view of a third embodiment of the arrangement 10 according to the invention for fastening a tailpipe cover 12 to a tailpipe 14. In contrast to the first embodiment of the arrangement 10, a bracket 18 and another bracket 28 have different lengths 40, 42. Only the bracket 18 is arranged with its free end 22 on the tailpipe projection 44. The other bracket 28 can brace the bracket 18, when, during the movement of the tailpipe cover 12, the bracket 18 is pushed against the tailpipe projection 44 and is thereby deformed. The brackets 18, 28 form the shape of a lower case lambda letter.

Figure 4:
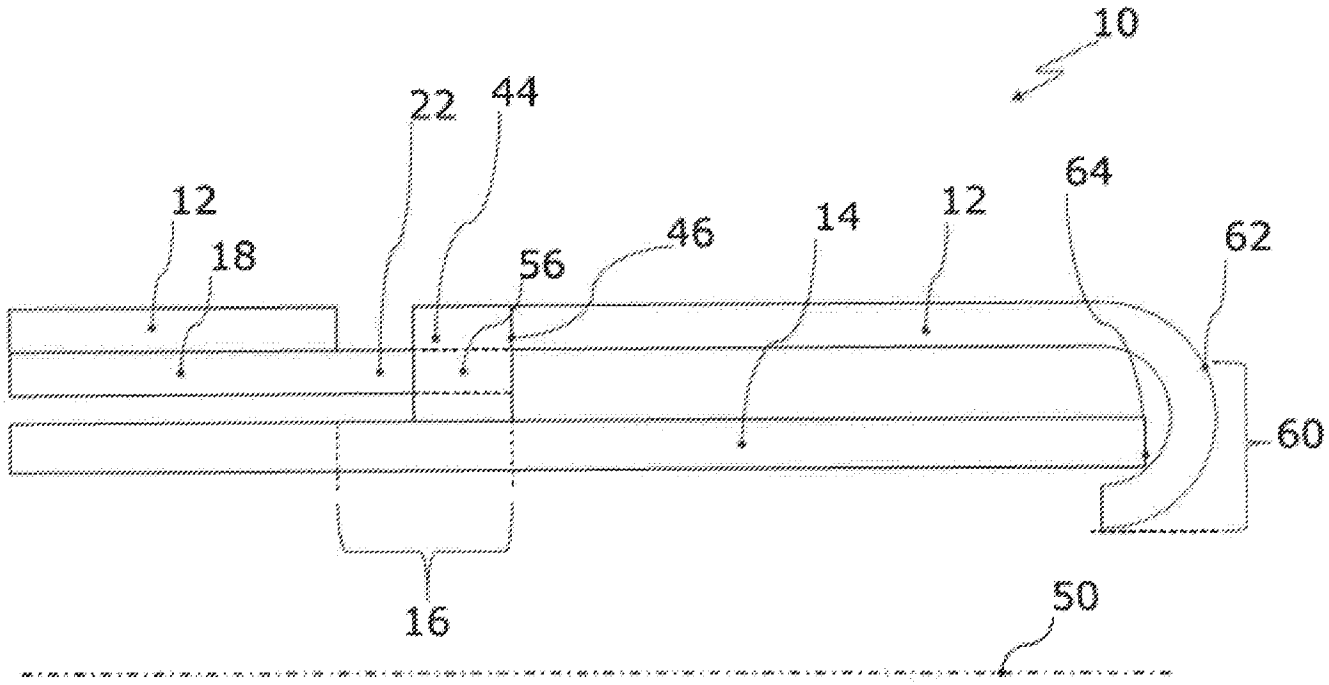
FIG. 4 is a schematic partial longitudinal section of the arrangement for fastening a tailpipe cover according to FIG. 1 or 2.

FIG. 4 depicts a longitudinal section through the first and second embodiments respectively of the arrangement 10 according to the invention for fastening a tailpipe cover 12 to the tailpipe 14. Depicted are the tailpipe 14 and the tailpipe projection 44 arranged on the tailpipe 14. The tailpipe projection 44 is arranged on the edge 46 of the recess 16 of the tailpipe cover 12. For the latching engagement of the tailpipe projection 44, the bracket 18 arranged on the tailpipe cover 12 abuts the tailpipe projection 44 with its free end 22. Alternatively or additionally, for this purpose a curve-shaped section 56 of the bracket 18 can engage around the tailpipe projection 44.

The tailpipe cover 12 has an end section 60 having an arc-shaped profile 62, which contacts a free end 64 of the tailpipe 14 for additional anchoring of the tailpipe cover 12. Also depicted is the symmetry and longitudinal axis 50 of the tailpipe cover 12.

Figure 5:
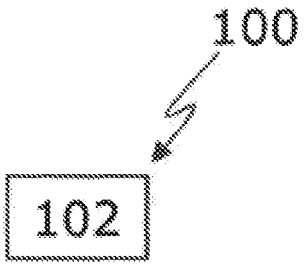
FIG. 5 is a schematic representation of a method for fastening a tailpipe cover.

FIG. 5 schematically portrays a method 100 for fastening a tailpipe cover 12 to a tailpipe 14. In a step 102, a tailpipe cover 12 is thereby latched by the lateral deflection of a bracket 18, which is arranged on the tailpipe cover 12, in the circumferential direction of the tailpipe cover 12, to a tailpipe projection 44, which is arranged on the tailpipe 44.

When performing an overview of all figures of the drawing, the invention relates in summary to an arrangement 10 for fastening a tailpipe cover 12 to a tailpipe 14. The arrangement 10 has a tailpipe cover 12, a tailpipe 14 and a bracket 18. The bracket 18 is arranged on the tailpipe cover 12. The tailpipe cover 12 can hereby be latched to the tailpipe 14 at a tailpipe projection 44 arranged on the tailpipe 14, by the bracket 18 being laterally deflected in the circumferential direction of the tailpipe cover 12. The circumferential direction can thereby be defined relative to the longitudinal axis 50 of the tailpipe cover 12 such that the circumferential direction corresponds to a direction perpendicular to the radial extension of the tailpipe cover, wherein the radial extension begins at the longitudinal axis 50.

What is claimed is:

1. A tailpipe cover arrangement, comprising:

a tailpipe and an arrangement for fastening a tailpipe cover to the tailpipe, comprising a bracket, which is arranged or designed on the tailpipe cover of the arrangement in such a manner that the tailpipe cover can be latched to a tailpipe projection by the lateral deflection of the bracket in the circumferential direction of the tailpipe cover;

wherein the tailpipe projection is fixed in its position;

wherein the tailpipe cover is latched to the tailpipe projection after the lateral deflection of the bracket in the circumferential direction of the tailpipe cover;

wherein the tailpipe cover has a recess on one end at which the bracket is designed or arranged, wherein the edge of the recess can adjoin the tailpipe projection in a form-fitting manner at least sectionally in such a manner that the recess forms a stop for the tailpipe projection;

wherein, compared to a fixed end of the bracket, a free, non-fastened end of the bracket is closer to the end of the tailpipe cover, which in an axial direction parallel to the longitudinal axis of the tailpipe cover is opposite the end of the tailpipe cover with the recess; and an additional bracket, which is arranged or designed on the tailpipe cover, wherein the tailpipe cover is latched to the tailpipe projection by the bracket and the additional bracket.

2. The tailpipe cover arrangement according to claim 1, wherein the bracket and the additional bracket are arranged or designed so as to converge towards each other at an acute angle.

3. The tailpipe cover arrangement according to claim 1, wherein the bracket and the additional bracket have the same length.

4. The tailpipe cover arrangement according to claim 1, wherein the bracket and the additional bracket have different lengths.

5. The tailpipe cover arrangement according to claim 1, wherein the bracket and the additional bracket are arranged or designed on opposite sides of the recess of the tailpipe cover, wherein the brackets, with their respective free ends, are oriented pointing into the recess.

6. The tailpipe cover arrangement according to claim 1, wherein the bracket has an arc-shaped section, by means of which it can partially engage around the tailpipe projection in such a manner that the tailpipe cover is latched to the tailpipe projection.

7. A method for fastening the tailpipe cover of the tailpipe cover arrangement to the tailpipe according to claim 1, wherein the tailpipe cover of the tailpipe cover arrangement has the bracket, wherein the tailpipe cover is latched to the tailpipe projection by the lateral deflection of the bracket in the circumferential direction of the tailpipe cover.

8. A tailpipe cover arrangement, comprising:

a tailpipe and an arrangement for fastening a tailpipe cover to the tailpipe, comprising a bracket, which is arranged or designed on the tailpipe cover of the arrangement in such a manner that the tailpipe cover can be latched to a tailpipe projection by the lateral deflection of the bracket in the circumferential direction of the tailpipe cover;

wherein the tailpipe projection is fixed in its position to the tailpipe;

wherein the tailpipe cover is latched to the tailpipe projection after the lateral deflection of the bracket in the circumferential direction of the tailpipe cover;

wherein the tailpipe cover has a recess on a first end at which the bracket is designed or arranged, wherein the recess extends inwardly starting from the first end of the tailpipe cover and extends to an inner edge of the recess , wherein the inner edge of the recess is configured to adjoin the tailpipe projection in a form-fitting manner at least sectionally in such a manner that the inner edge of the recess forms a stop for the tailpipe projection;

wherein, compared to a fixed end of the bracket which is attached to the tailpipe cover closer to the first end of the tailpipe cover, a free, non-fastened end of the bracket projects towards the inner edge of the recess, wherein a second end of the tailpipe cover in an axial direction parallel to a longitudinal axis of the tailpipe cover is opposite the first end of the tailpipe cover with the recess.

* * * * *